US005588945A

United States Patent [19]

Lauderbaugh

[11] Patent Number: 5,588,945

[45] Date of Patent: Dec. 31, 1996

[54] METHOD AND DEVICE FOR SPACING A CORRUGATING FINGER RELATIVE TO A CORRUGATING ROLL

[75] Inventor: David M. Lauderbaugh, Roswell, Ga.

[73] Assignee: Corrugated Gear & Services, Inc., Alpharetta, Ga.

[21] Appl. No.: 395,379

[22] Filed: Feb. 21, 1995

[51] Int. Cl.[6] ..... B31B 1/00; B31F 1/20

[52] U.S. Cl. ..... 493/480; 493/381; 493/477; 493/478; 493/479; 156/473; 428/192; 428/188

[58] Field of Search ..... 493/477–480, 493/381; 156/473, 472, 471, 470; 428/192, 188

[56] References Cited

U.S. PATENT DOCUMENTS

| | | | |
|---|---|---|---|
| 3,346,436 | 10/1967 | Meister | 156/473 |
| 4,005,529 | 2/1977 | Nikkel | 156/473 |
| 4,086,120 | 4/1978 | Cosby et al. | 156/473 |
| 4,093,497 | 6/1978 | Leff | 156/473 |
| 4,104,107 | 8/1978 | Christensen | 156/473 |
| 4,251,313 | 2/1981 | Abe . | |
| 4,265,697 | 5/1981 | King . | |
| 4,270,969 | 6/1981 | Kelley . | |
| 4,368,094 | 1/1983 | Mayer . | |
| 4,447,285 | 5/1984 | Lussana . | |
| 4,581,095 | 4/1986 | Schommler | 156/473 |
| 4,584,052 | 4/1986 | Baum | 156/473 |
| 4,618,394 | 10/1986 | Hoffmann . | |

*Primary Examiner*—Jack W. Lavinder
*Assistant Examiner*—Darren Ark
*Attorney, Agent, or Firm*—Jones & Askew

[57] ABSTRACT

A device for and method of spacing a corrugating guide finger relative to a corrugating roll. The device includes a tail and a head. The head has a slot therethrough for sliding receipt of the corrugating guide finger. To space the finger, the slot is slidingly received onto the finger and the tail simultaneously contacts the inner surface of the finger and the outer surface of the corrugating roll.

23 Claims, 4 Drawing Sheets

METHOD AND DEVICE FOR SPACING A CORRUGATING FINGER RELATIVE TO A CORRUGATING ROLL

TECHNICAL FIELD

The present invention relates generally to the corrugated board industry, and relates more specifically to a method and device for spacing a corrugating guide finger relative to a corrugating roll in a corrugated board manufacturing machine.

BACKGROUND OF THE INVENTION

In the corrugated board industry, corrugated board is manufactured by adhering a corrugated, or fluted, sheet of paper to one or more flat sheets. A fluted sheet is referred to as a "medium", and a flat sheet is referred to as a "liner". A corrugated board consisting of a medium adhered to a single liner is referred to as "single ply corrugated board", "single ply board", or simply "single ply". By applying an additional liner to the other side of a medium, "double ply corrugated board", "double ply board", or "double ply" is formed. Single ply board is often used in packing fragile objects such as china and glass. Double ply board is often used in creating packaging products such as corrugated boxes and cases.

A fluted sheet is generally formed on a corrugating roll machine. The corrugating roll machine includes in series an upper corrugating roll, a lower corrugating roll, and a pressure roll, respectively, set to engage one another such that a medium can travel in a serpentine path therebetween. An example of such a system is set forth in FIG. 1. In operation of a corrugating roll machine, the upper corrugating roll 11 (FIG. 1) and the pressure roll 20 (FIG. 1) rotate in a clockwise direction, and the lower corrugating roll 12 (FIG. 1) rotates counterclockwise to move the medium 50 (FIG. 1) from the left side of FIG. 1 to the right.

The upper and lower corrugating rolls 11 and 12 are cylindrical and include multiple, elongate, sinusoidal protrusions 14 extending radially from the axis of rotation and along the length of the corrugating rolls. These protrusions are referred to as "flutes". A medium is formed by passing a flat sheet between the intermeshing flutes on the upper corrugating roll 11 and lower corrugating roll 12. As the sheet 50 passes over the flutes on the surfaces of the intermeshed corrugating rolls, the sheet conforms to the shape of the flutes. Steam and heat are introduced to accelerate the fluting process.

After the medium passes through the two intermeshing corrugating rolls, it continues to remain pressed against the flutes of the lower corrugating roll 12. As the medium travels around the path of the lower corrugating roll, the outer surface of the medium contacts a glue roll 22 (FIG. 1). The glue roll has adhesive on its surface so that it may apply adhesive to the contacting surface of the medium. The medium continues to travel along the outside of the lower corrugating roll to the pressure roll, where a liner 52 is inserted between the outer, glue-coated side of the medium and the pressure roll. The pressure applied by the pressure roll causes the medium to adhere to the liner so that a single ply board is formed.

In the process of manufacturing the single ply board, it is critical that the flutes of the medium are spaced evenly along the liner so that they adhere to the liner in a consistent manner. In order for this formation to be consistently accomplished, the medium must remain firmly against the flutes of the lower corrugating roll while the liner is being glued to the medium. However, once the medium is fluted, it has a tendency to return to a flattened state and pull away from the lower corrugating roll. If the medium is permitted to release from the lower corrugating roll, the flutes of the medium may become misaligned at the point the medium contacts the liner and the pressure roll. Thus, the medium must be held against the surface of the lower corrugating roll to ensure proper application of the adhesive and to prevent the flutes from overlapping or flattening out when they adhere to the liner at the pressure roll.

A series of guide elements 30, called "corrugating guide fingers", are used to keep the medium in contact with the lower corrugating roll. These corrugating guide fingers are mounted against the lower corrugating roll from a point adjacent to the upper corrugating roll to a location near the pressure roll. To maintain maximum contact between the medium and the lower corrugating roll, it is desirable to have the corrugating guide fingers contact the medium for as much of the distance as possible. The majority of problems occur at the juncture of the lower corrugating roll 12 and the pressure roll 20, hereinafter referred to as the "nip". The main problem that occurs at the nip is the corrugating guide finger does not extend far enough into the nip to maintain the medium against the lower corrugating roll until the medium reaches the contact point with the liner. At any location where the finger is not in contact with the medium prior to the juncture with the pressure roll, there is a possibility that the medium will pull away from the lower corrugating roll. If the medium separates from the lower corrugating roll, the flutes of the medium can overlap or bunch before the medium contacts the liner, which could cause the pressure roll to jam and shut down the entire corrugating process.

At present, corrugating guide fingers are substantially arc-shaped to follow the curve of the corrugating roll. Existing corrugating guide fingers have an outer arcuate surface and an inner arcuate surface. The inner arcuate surface has a radius that is slightly greater than the radius of the corrugating roll. The corrugating guide fingers define a leading end at the upstream, or upper corrugating roll, side of the lower corrugating roll, and a trailing end at the downstream, or pressure roll, side. The leading end is typically rounded and designed to pull the fluted medium away from the intermeshing flutes of the upper corrugating roll 11. The trailing end is designed to hold the medium in contact with the lower corrugating roll 12 before the medium adheres to the liner.

The trailing edge of existing corrugating guide fingers includes a linear surface joining the outer and inner arcuate surfaces. This surface creates a tangential point of contact between the finger and the pressure roll, and limits the amount the finger may be inserted into the nip. In addition, the tip of existing corrugating guide finger trailing ends are often blunt and squared-off, resulting in a tip which measures approximately one eighth to one sixteenth of an inch in width. This dimension is significant in that it does not permit the trailing edge to approach the nip, resulting in a gap where the medium is not supported before being attached to the liner. This gap results in a loss of contact with approximately one flute of the medium just prior to the contact of the liner with the medium. This, in turn, results in poor quality of corrugation and ultimately, a poor quality product.

Because corrugating guide fingers must stay in position against the medium, the corrugating guide fingers must be properly mounted relative to the lower corrugating roll. The preferred spacing between the inner surface of the corrugating guide finger and the outer surface of the lower corrugating roll is equal to the thickness of the medium. It is preferred that this spacing be consistent along the entire length of the corrugating guide finger. The spacing is hard to achieve because the medium is not in place when the fingers are installed. In addition, the exact spacing is difficult to achieve due to the confined space in which machinists are able to work to mount the corrugating guide fingers. Often, the corrugating guide fingers are spaced relative to the corrugating roll by visual inspection alone. This method of spacing is extremely arbitrary and usually results in an inappropriate gap between at least one portion of the corrugating guide finger and the lower corrugating roll.

If a portion of a finger is positioned too closely to the corrugating roll surface, there may be insufficient room for the medium to travel, which may cause the medium to catch and rip. This results in a shut down of the equipment which halts the entire manufacturing process.

If a portion of a finger is mounted too far away from the surface of the lower corrugating roll, the finger may allow too much play in the travel of the medium, which may cause the medium to move away from the lower corrugating roll or glue roll. This free travel may result in insufficient or excessive application of adhesive or bunching of the flutes of the medium before the medium reaches the nip, and ultimately may result in a poor quality product.

Thus, there is a need for a device that properly spaces a corrugating guide finger from a corrugating roll so that the corrugating guide finger may be fixed the correct distance from the corrugating roll.

There is a further need for a device that spaces a corrugating guide finger consistently and accurately along the corrugating guide finger's length relative to a corrugating roll to prevent tearing of the medium or creation of a poor quality product.

There is still a further need for a method of spacing a corrugating guide finger relative to a corrugating roll.

There is yet a further need for a method of spacing a corrugating guide finger consistently and accurately relative to a corrugating roll to prevent tearing of the medium or creation of poor quality product.

SUMMARY OF THE INVENTION

As will be seen, the present invention overcomes these and other disadvantages associated with prior art methods and devices for spacing corrugating guide fingers. Stated generally, the present invention is a method and device for spacing a corrugating guide finger. The device has a head and an elongated tail. The tail is connected to the head and is placed between the inner surface of a corrugating guide finger and the outer surface of a corrugating roll. The head may include a trailing end panel configured to be placed between the trailing end of the corrugating guide finger and a pressure roll. The head may be presented in the form of a sleeve, and a slot may be provided therethrough for sliding engagement with the corrugating guide finger, as well as a hole for receiving a pointed end of the trailing end of the corrugating guide finger.

The method of the present invention includes the step of first orienting a corrugating guide finger having inner and outer surfaces and leading and trailing ends proximate to a corrugating roll having an outer roll surface. Second, a spacer is provided including a head and an elongated tail, the head for engaging the corrugating guide finger. Then, the elongated tail is positioned to contact the inner surface of the corrugating guide finger and the outer roll surface. Finally, the finger is secured in this position to a fixed structure.

Accordingly, it is an object of the present invention to provide a device that properly spaces a corrugating guide finger relative to a corrugating roll so that the finger may be fixed in the correct position.

It is a further object of the present invention to provide a device that spaces a corrugating guide finger consistently and accurately relative to a corrugating roll to prevent tearing of the medium or creation of poor quality product.

It is still a further object of the present invention to provide a method of spacing a corrugating guide finger relative to a corrugating roll.

It is yet a further object of the present invention to provide a method of spacing a corrugating guide finger consistently and accurately relative to a corrugating roll to prevent tearing of the medium or creation of poor quality product.

These and other objects, features and advantages of the present invention will become apparent upon reading the following detailed description of the preferred embodiments of the invention, when taken in conjunction with the drawings and appended claims.

BRIEF DESCRIPTION OF THE DRAWINGS

The invention will now be described with reference to the accompanying drawings, which illustrate a preferred embodiment of the improved corrugating guide finger, falling within the scope of the appended claims, and in which:

DETAILED DESCRIPTION OF THE INVENTION

Figure 1:
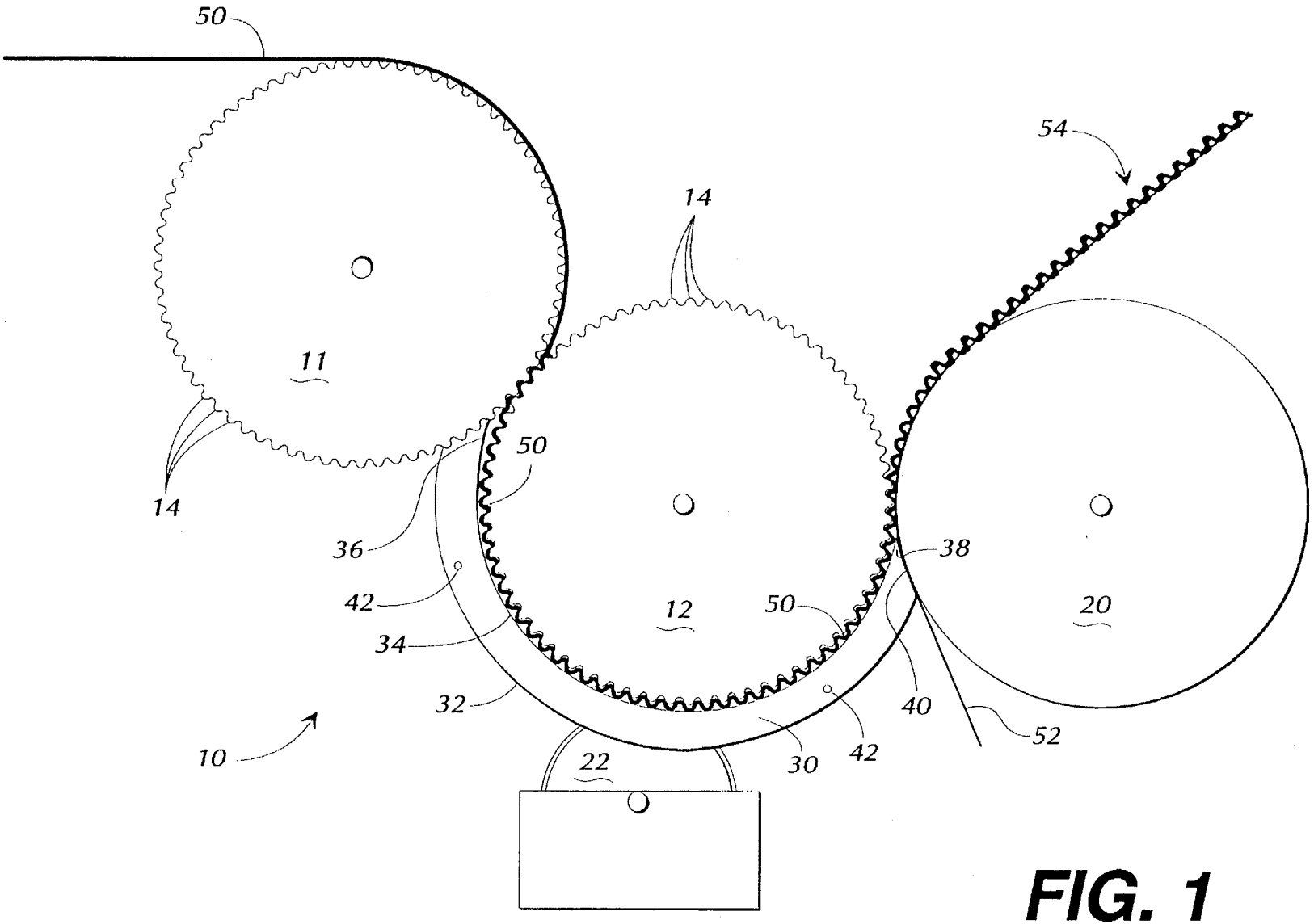
FIG. 1 is a side view of a single ply, corrugating roll machine embodying the present invention.

Referring now in more detail to the drawing, in which like numerals indicate like parts throughout the several views, an improved corrugating assembly 10 is shown in FIG. 1. The assembly 10 includes an upper corrugating roll 11 and a lower, or main, corrugating roll 12. The corrugating rolls 11, 12 are substantially cylindrical and include flutes 14 extending radially along the length of the rolls. A pressure roll 20 is located on the opposite side of the lower corrugating roll 12 from the upper corrugating roll 11, and a glue roll 22 is mounted adjacent to the bottom of the lower corrugating roll 12. The glue roll 22 is configured to apply adhesive, on its outer surface, to the outer surface of the corrugating roll 12.

The glue roll 22 includes a series of annular grooves (not shown, but well known in the art), adapted to receive a plurality of corrugating guide fingers 30. The corrugating guide fingers 30 preferably extend along the outer, bottom portions of the lower corrugating roll 12 from a position adjacent to the upper corrugating roll 11 to a point near the nip 60, as is described in detail below. Each corrugating guide finger 30 defines a first, outer surface 32, a second, inner, concave, arcuate surface 34, a first rounded end 36, and a second pointed end 38. The first rounded end 36 is received in a groove (not shown) in the upper corrugating gear 11, in a manner known in the art.

A third arcuate surface 40 of the corrugating guide finger 30 joins the first, outer surface 32 and the second, inner arcuate surface 34 at the trailing end of the corrugating guide finger. The corrugating guide fingers 30 are mounted against the surface of the lower corrugating roll 12 such that the pointed end 38 of each of the fingers is proximate to the surface of the pressure roll 20. Mounting holes 42 are located on the finger 30 proximate to the first, outer surface to secure the finger to a fixed structure (not shown). The finger 30 may be secured to the fixed structure by any number of acceptable securing means known to one of ordinary skill in the art, such as screws, bolts, pins and the like.

The practice of the invention can best be understood by reference to FIG. 1. Generally, a sheet 50, which becomes the medium, is fed through the corrugating assembly 10 such that the sheet follows the outer circumference of the lower corrugating roll 12 and creates a serpentine path which extends between the lower corrugating roll and (1) the upper corrugating roll 11, (2) the glue roll 22, and (3) the pressure roll 20, respectively. A liner 52 is fed between the pressure roll 20 and the medium 50 so that the liner may join the medium to form a single-ply board 54.

As the sheet 50 moves between the intermeshing protrusions 14 on the surface of the corrugating rolls 11, 12, it conforms to the shape of the protrusions and becomes fluted. The sheet 50 is pulled from the upper corrugated roll by the rounded end 36 of the fingers 30 and travels along the surface of the corrugating roll 12 as the corrugating roll rotates while being held against the surface of the corrugating roll 12 by the corrugating guide fingers 30. Preferably, the arc formed by the second arcuate surface 34 of the fingers 30 is defined by a radius with a dimension which is approximately equal to the sum of the radius of the lower corrugating roll 12 and the thickness of the medium 50. Tolerances are allowed for the compressibility of the medium. This configuration allows for maximum contact between the fingers 30 and the medium 50.

As the medium 50 continues to rotate with the lower corrugating roll 12, the sheet 50 contacts the glue roll 22, and adhesive is applied to the fluted sheet on the areas in contact therewith. The fluted sheet 50 continues to travel along the surface of the corrugating roll 12 until the fluted, glue-covered surfaces of the sheet contact the liner 52. The pressure roll 20 receives the sheet 50 and the liner 52 and adds additional pressure to the bond to accelerate the adhesion process and to form the single ply corrugated board 54.

Figure 4:
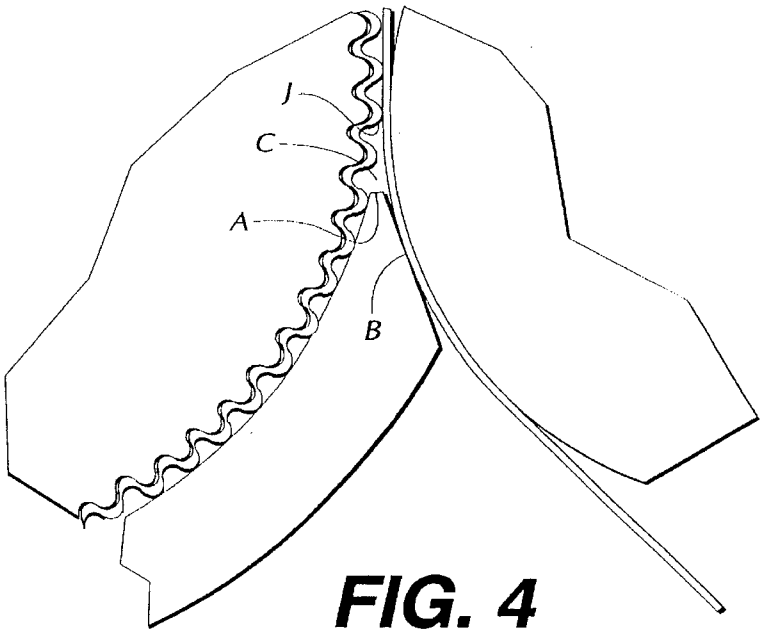
FIG. 4 PRIOR ART
FIG. 4 is a detailed view of a prior art corrugating guide finger.
Figure 2:
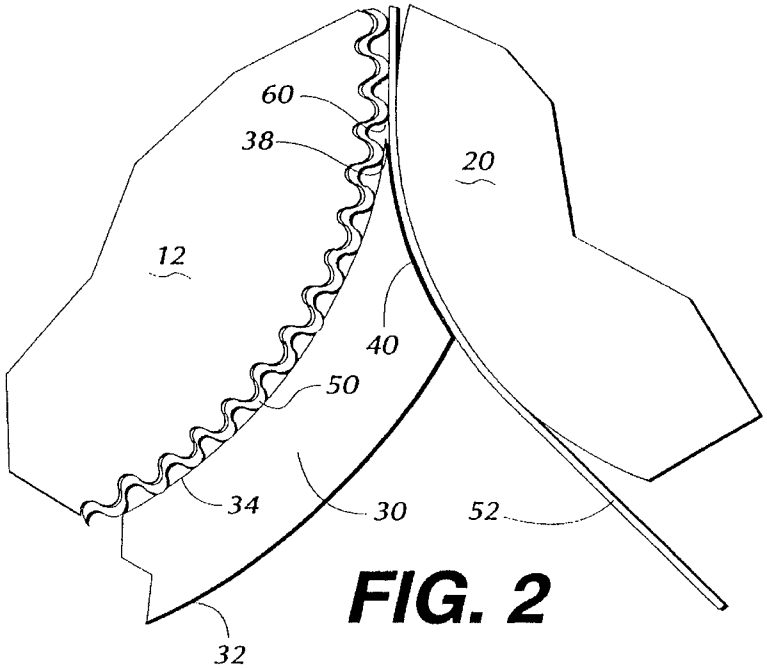
FIG. 2 is a detailed view of a corrugating guide finger for use in the corrugating roll machine of FIG. 1.
Figure 3:
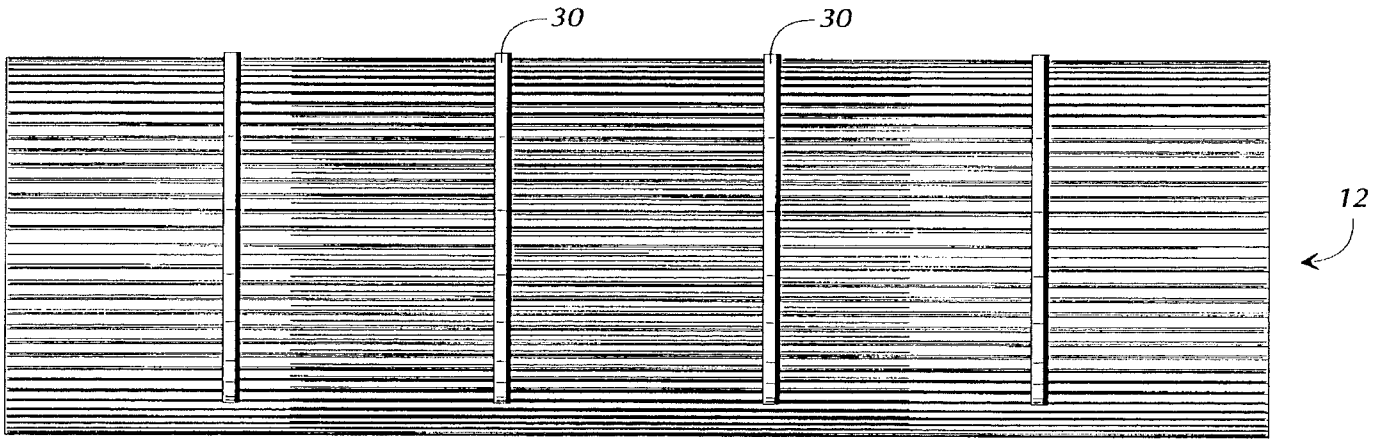
FIG. 3 is a bottom view of the lower corrugating roll of FIG. 1.
Figure 7:
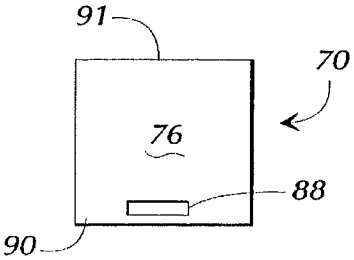
FIG. 7 is a trailing edge view of the spacer of FIG. 5.

As can best be seen by FIG. 2, the improved design of the pointed end 38 of the corrugating guide finger 30 offers back-to-back concave surfaces 34, 40, resulting in a pointed, extended end 38. The extended concave shape of the inner arcuate surface 34 permits the finger 18 to extend further around the lower corrugating roll 12 and into the juncture, or nip 60, of the lower corrugating roll 12 and the pressure roll 20. By contrast, prior art corrugating guide fingers (see FIG. 4) end in a blunt point A that prevents the finger from extending a maximum distance into the juncture, leaving a gap C uncovered by a corrugating guide finger where the medium might stray from the flutes 14 on the lower corrugating roll 12.

Preferably, the arc formed by the third arcuate surface 40 defines a radius with a dimension which is approximately equal to the sum of the radius of the pressure roll 20 and the thickness of the liner 52. Tolerances are allowed for the compressibility of the liner. By having this configuration, the concave third arcuate surface 40 and second arcuate surface 34 may be "jammed" into the juncture of the liner 52 and the medium 50, which maximizes contact between the medium 50 and the finger 30 before the liner and medium 50 meet at the nip 60. The prior art, on the other hand, presents a linear surface for the third surface, which restricts the contact between the liner and the finger to a single contact point B. This tangential contact further limits the ability of the finger to extend into the juncture J, and does not provide the positive control of the medium the present invention provides.

The improved design of the pointed end 38 of the finger 30 enables the finger to maintain pressure on the fluted sheet 50 against the corrugating roll 12 until the flutes of the sheet 50 are in position against the liner 52, and the pressure between the corrugating roll 12 and the pressure roll 20 can hold the sheets together. Because the third arcuate surface 40 matches against the outside of the liner 52, the point 38 may be "jammed" into the nip 60, allowing the maximum amount of support for the medium 50. This continuous contact between the corrugating guide fingers 30 and fluted sheet 50, as well as the contact against the liner 52 provides for a consistent product and minimizes jamming that may occur where the sheet and liner join at the pressure roll 20. This configuration results in an improved quality product and decreases down time, which ultimately results in savings for the manufacturer.

As described above, the corrugating guide fingers 30 preferably maintain the medium 50 against the lower corrugating roll 12 so that the medium will not stray from the flutes 14 of the roll and try to return to its natural, flat orientation. In order for this relationship to be properly met, the corrugating guide fingers 30 preferably are spaced apart from the lower corrugating roll 12 a distance which is approximately equal to the thickness of the medium 50. This spacing is difficult to achieve because the corrugating guide fingers 30 are generally not installed while the medium 50 is in place, and a machinist attempting to install the corrugating guide fingers 30 must work in a confined space when mounting the corrugating guide fingers. Moreover, with the corrugating guide finger 30 described above, it is preferable that the third, arcuate surface 40 of the corrugating guide finger be spaced from the pressure roll 20 a distance which is equal to the thickness of the liner 52. To resolve these problems, applicants have developed a temporary spacer 70 for easing installation of the corrugating guide fingers 30.

As can be seen in FIGS. 5–8, the spacer 70 preferably includes a head 72 attached to a tail 74. The head 72 preferably consists of a sleeve 75 formed from: (1) an end portion of the tail 74; (2) a trailing end panel 76; (3) a top panel 78; and (4) a leading end panel 80. A glue panel 82 extends from the leading end panel 80 for attachment to a portion of the tail 74. By attaching the glue panel 82 in this manner, the sleeve 75 is formed. A slot 86 is formed in the leading panel 80, and in the embodiment shown, extends through the glue panel 82, the leading end panel 80, and most of the top panel 78, the significance of which will be described in detail below. A hole 88 is included along the bottom side of the trailing end panel 76, the significance of which will also be described below.

Figure 6:
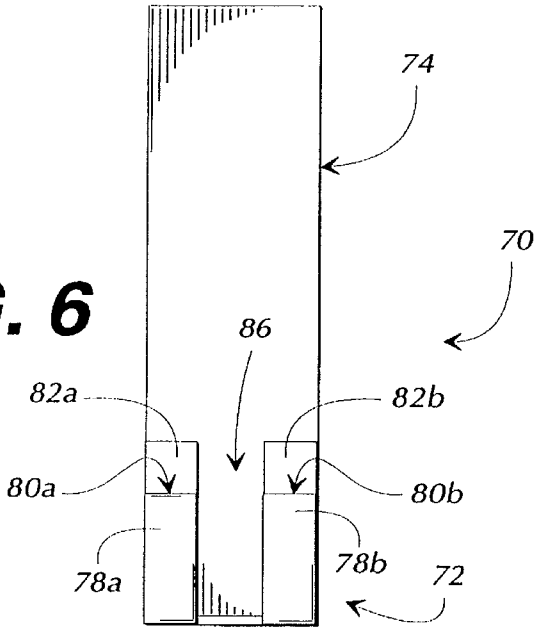
FIG. 6 is a top view of the spacer of FIG. 5.

The spacer 70 is preferably formed of an elongate piece of paperboard. The elongate strip is first folded or scored in four locations 90, 91, 92, 93 so as to form the trailing panel 76, the top panel 78, the leading panel 80, and the glue panel 82. Before the sleeve 75 is formed, the slot 86 is cut so that it extends through the glue panel 82 and the leading panel 80, and preferably at least part of the way through the upper panel 78. The hole 88 is then cut along the fold or score line 90 located between the tail 74 and the trailing panel 76 at a location closest to the tail 74. The glue panel 82 is then attached, preferably by gluing, to the tail 74. It is to be understood that because the slot 86 extends through the glue panel 82 and the leading panel 80, the glue panel 82 is therefore split and attached at two separate sections 82*a*, 82*b* on opposite sides of the tail 74, as can best be seen in FIG. 6. Likewise, the leading panel 80 is split into two different sections 80*a*, 80*b*. Depending upon the length of the slot 86, the top panel 78 may also be split into separate panels 78*a* and 78*b*, such as is shown in FIG. 6.

Figure 8:
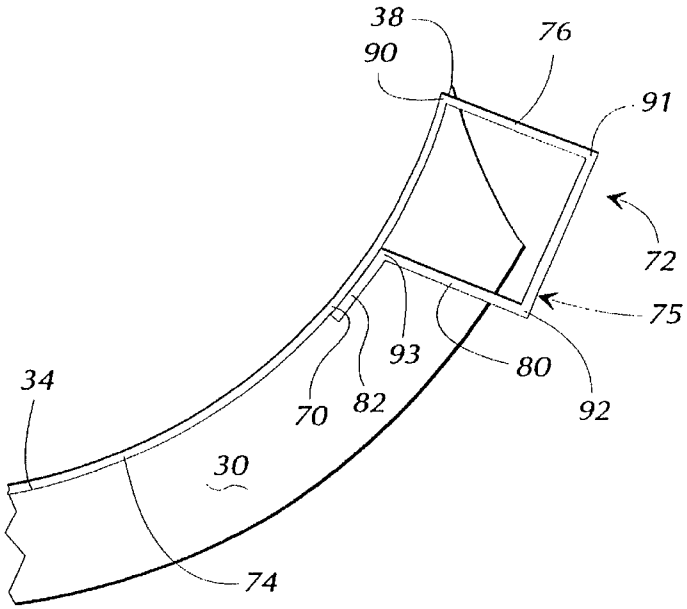
FIG. 8 is a side view of the spacer of FIG. 5, shown as installed on a corrugating guide finger.
Figure 5:
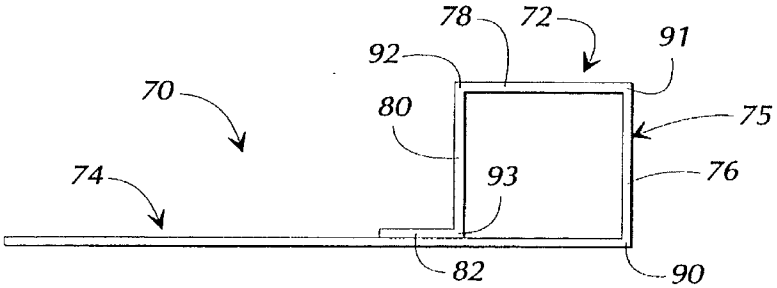
FIG. 5 is a side view of a spacer for use in properly aligning a corrugating guide finger during installation.
Figure 9:
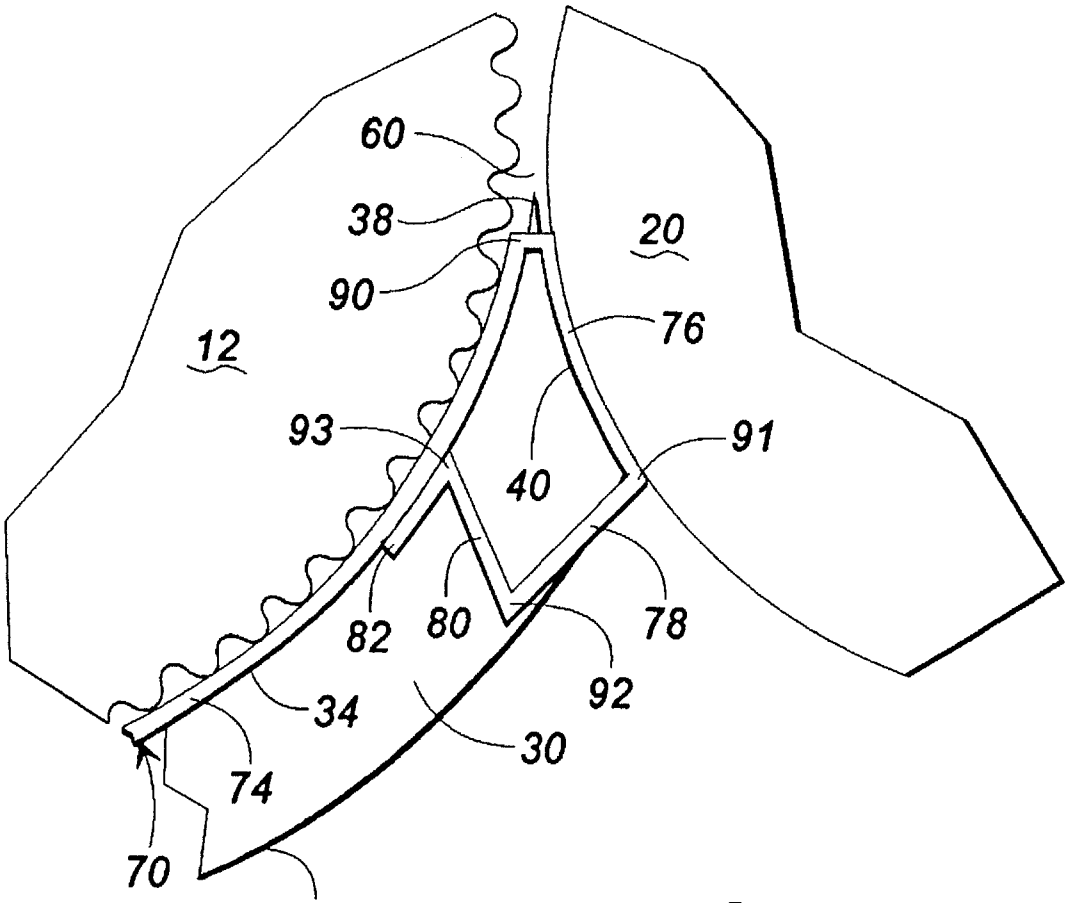
FIG. 9 is a side view of the spacer of FIG. 5, shown as installed on a corrugating guide finger and against a corrugating roll and a pressure roll.

The function and operation of the spacer 70 can best be understood with reference to FIGS. 8 and 9. The spacer 70 serves to set the corrugating guide finger 30 apart from the lower corrugating roll 12 and the pressure roll 20 as the corrugating guide finger is being mounted to a fixed structure (not shown). With reference to FIG. 8, the pointed end 38 of the corrugating guide finger 30 is inserted through the slot 86 and into the hole 88 such that the tail 74 extends along the second, inner, concave, arcuate surface 34 of the corrugating guide finger 30. The head 72 serves to hold the spacer 70 in place against the corrugating guide finger 30 so that the tail 74 may be aligned along the underside of the corrugating guide finger, and the trailing end panel 76 extends above the pointed end 38 and adjacent to the third, arcuate surface 40 of the corrugating guide finger.

The spacer 70 and the corrugating guide finger 30 are then placed against the outer surface of the lower corrugating roll 12 so that the tail 74 is sandwiched between the corrugating guide finger and the lower corrugating roll. As the corrugating guide finger 30 is put in place, the pointed end 38 of the corrugating guide finger is jammed into the nip 60 such that the trailing end panel 76 is pressed between the third arcuate surface 40 of the pointed end 38 of the corrugating guide finger and the pressure roll 20. As the trailing end panel 76 is pressed forward, the rest of the sleeve 75 leans forward and forms the shortened parallelogram shown in FIG. 9. Because the slot 86 extends partly up the top panel 78, the upper edge of the corrugating guide finger 30 is received within the portion of the slot extending up the top panel. The corrugating guide finger may then be mounted to a fixed structure (not shown).

It can be understood from the above description that by correct use of the spacer 70, the corrugating guide finger 30 is distanced apart from the lower corrugating roll 12 a distance which is equal to the thickness of the tail 74. By providing a tail 74 which is the thickness of the medium 50, the corrugating guide finger is spaced along its length the optimal distance from the lower corrugating roll 12. Likewise, by providing a trailing end panel 76 which is the thickness of the liner 52, the corrugating guide finger 30 is spaced from the pressure roll the desired amount.

Thus, the spacer 70 maintains the appropriate position of the corrugating guide finger 30 while the finger is being secured and tightened in position. The corrugating machine may then be turned on and the spacer 70 simply slides off the finger 30, passes through the corrugating process, and is discarded as it clears the assembly.

The design of the head 72 shown in the drawing is preferred because of its ability to be easily installed upon a corrugating guide finger 30, and the arrangement of the configuration which allows material to be presented both between the corrugating guide finger 30 and the lower corrugating roll 12, and between the corrugating guide finger and the pressure roll 20. The sleeve 75 maintains the slot 86 in a perpendicular orientation relative to the tail 74, and provides a handle for the machinist to install the corrugating guide finger 30 on the spacer 70 and to hold the spacer on the corrugating guide finger as it is placed against the lower corrugating roll 12. Also, and more importantly, the arrangement of the sleeve 75 presents the trailing end panel 76 against the pressure roll 20 as the corrugating guide finger 30 is being positioned relative to the lower corrugating roll 12. Thus, the corrugating guide finger 30 is spaced a distance from the pressure roll 20 which is equal to the thickness of the trailing end panel 76. As described above, this distance is preferably equal to the thickness of the liner 52.

It is to be understood that the head may be in any shape which presents at least some material between the corrugating guide finger 30 and the pressure roll 20 upon installation. As examples only, and not as a limitation, the head 72 may be configured so that the sleeve 75 is rounded instead of folded or scored, or the head may be formed with a small end panel extending past the hole 88, the end panel being manipulated to extend against the pressure roll 20. Preferably, the trailing end panel 76, or any material which is presented against the third, arcuate surface 40 of the corrugating guide finger 30, extends the length of the trailing end of the corrugating guide finger so that the trailing end may be spaced equally from the pressure roll 20 along its length.

It is also preferred that the tail 74 extend a length which is approximately the length of the corrugating guide finger so that the finger may be uniformly spaced from the lower corrugating roll 12 along the length of the corrugating guide finger. This configuration permits the corrugating guide finger 30 to be properly spaced without manipulation, which permits the machinist to install the corrugating guide finger 30 with the least amount of difficulty. However, it is to be understood that the tail 74 may be of varying lengths which allow consistent spacing along the length of the corrugating guide finger 30.

The slot 86, by extending through part of the top panel 78, allows a machinist to easily align the pointed end 38 of the corrugating guide finger 30 with the hole 88. The slot 86, if provided on the head 72, may also be of varying lengths and configurations so as to accommodate a corrugating guide finger 30. It is preferable, however, that the slot extend through the glue panel 82 so that the tail 74 provides one uniform layer underneath the corrugating guide finger, as opposed to having two layers at the attachment of the glue panel. In addition, as described above, it is preferred that the slot 86 extend at least part of the distance through the top panel 78 so that the upper edge of the corrugating guide finger 30 may be received in the slot when the spacer 70 is placed into the nip 60.

The hole 88 enables a machinist to properly set the spacer relative to the corrugating guide finger 30. The spacer 70 may, alternatively, extend around the pointed end 38 of the corrugating guide finger 30, but such an arrangement would make it harder to maintain the spacer relative to the corrugating guide finger, and requires a hard turn in the spacer around the pointed end 38. Such a hard turn may cause a bulge of the spacer 70 at the pointed end 38, which may prevent full insertion of the pointed end into the nip 60.

It should be understood that numerous modifications or alternations may be made to the improved corrugating assembly without departing from the spirit and scope of the invention as set forth in the appended claims.

We claim:

1. A device for spacing a corrugating guide finger, having an outer surface and an inner surface, a leading end and a trailing end, relative to a corrugating roll defining an outer surface, the corrugating guide finger and the corrugating roll being arranged so as to receive a corrugating medium therebetween, the device comprising:

a head, configured for engagement with the corrugating guide finger wherein the head further comprises a hole for receipt of the trailing end of the corrugating guide finger; and a tail connected to the head and configured for placement between the inner surface of the corrugating guide finger and the outer surface of the corrugating roll.

2. The device of claim 1, wherein the device comprises paperboard.

3. The device of claim 1, wherein the head further comprises a panel configured to engage the trailing end of the corrugating guide finger.

4. The device of claim 1, wherein the length of the tail is approximately equal to the length of the inner surface of the corrugating guide finger.

5. The device of claim 1, wherein the thickness of the tail is approximately equal to the thickness of the corrugating medium.

6. The device of claim 1, wherein the head comprises:

an elongated strip having four, parallel folds thereon, the folds being perpendicular to the length of the strip and separating the strip into five panels, a first panel being located at one end of the strip and a fifth panel located at an opposite end of the strip when the strip is unfolded, a first fold separating the first and second panels, a second fold separating the second and third panels, a third fold separating the third and fourth panels, and a fourth fold separating the fourth and fifth panels, the strip being arranged such that the first, second, third and fourth panels form a sleeve and the fifth panel extends parallel to the first panel and is attached thereto.

7. The device of claim 6, wherein the second panel comprises a hole for receipt of the trailing end of the corrugating guide finger.

8. The device of claim 6, further comprising a slot extending along the length of the fifth panel and at least a portion of the fourth panel.

9. The device of claim 8, wherein the slot extends along the length of at least a portion of the third panel.

10. The device of claim 9, wherein the second panel comprises a hole for receipt of the trailing end of the corrugating guide finger.

11. The device of claim 10, wherein the second panel is configured to engage the trailing end of the corrugating guide finger.

12. A device for spacing a corrugating guide finger, having an outer surface and an inner surface, a leading end and a trailing end, relative to a corrugating roll defining an outer surface and a pressure roll defining a second outer surface, the corrugating guide finger, the corrugating roll, and the pressure roll being arranged such that the corrugating guide finger and the corrugating roll receive a corrugating medium therebetween, and the corrugating roll and the pressure roll-receive a corrugating liner therebetween, the device comprising:

a head comprising a trailing end panel configured for placement between the second outer surface and a trailing end of the corrugating guide finger; and a tail connected to the head and configured for placement between the inner surface of the corrugating guide finger and the outer surface of the corrugating roll.

13. The device of claim 12, wherein the device comprises paperboard.

14. The device of claim 12, wherein the head further comprises a hole for receipt of the trailing end of the corrugating guide finger.

15. The device of claim 12, wherein the length of the tail is approximately equal to the length of the inner surface of the corrugating guide finger.

16. The device of claim 12, wherein the length of the trailing end panel is approximately equal to the length of the trailing end of the corrugating guide finger.

17. The device of claim 12, wherein the thickness of the tail is approximately equal to the thickness of the corrugating medium.

18. The device of claim 12, wherein the thickness of the panel is approximately equal to the thickness of the corrugating liner.

19. The device of claim 12, wherein the head further comprises:

an elongated strip having four, parallel folds thereon, the folds being perpendicular to the length of the strip and separating the strip into five panels, a first panel being located at one end of the strip and a fifth panel located at a opposite end of the strip when the strip is unfolded, a first fold separating the first and second panels, the second fold separating the second and third panels, the third fold separating the third and fourth panels, and the fourth fold separating the fourth and fifth panels, the strip being arranged such that the first, second, third and fourth panels form a sleeve and the fifth panel extends parallel to the first panel and is attached thereto.

20. The device of claim 19, wherein the second panel comprises the trailing end panel.

21. The device of claim 19, wherein the second panel comprises a hole for receipt of a trailing end of the corrugating guide finger.

22. The device of claim 19, further comprising a slot extending along the length of the fifth panel and at least a portion of the fourth panel.

23. The device of claim 22, wherein the slot extends along the length of at least a portion of the third panel.

* * * * *